United States Patent [19]

Speer

[11] 4,241,850

[45] * Dec. 30, 1980

[54] PERSONAL PROTECTIVE DEVICE

[76] Inventor: Eugene M. Speer, c/o Mr. Donald W. Hedrick P. O. Box 2631, Orlando, Fla. 32803; Paul G. Hahn, 693 Granville Dr., Winter Park, Fla. 32789.

[ * ] Notice: The portion of the term of this patent subsequent to Dec. 30, 1994, has been disclaimed.

[21] Appl. No.: 944,636

[22] Filed: Sep. 21, 1978

Related U.S. Application Data

[63] Continuation of Ser. No. 633,124, Nov. 18, 1975, abandoned.

[51] Int. Cl.[3] ..... B67B 7/24

[52] U.S. Cl. ..... 222/39; 222/82; 222/78; 222/162; 222/325; 63/1 R; 222/336; 239/154

[58] Field of Search ..... 222/4, 5, 39, 82, 83, 222/83.5, 78, 162, 175, 325, 326, 336, 340; 109/28, 29, 31; 224/179, 164, 219; 116/6, 77, 83, 142 FP, DIG. 44, 99; 63/1 R, DIG. 2; 239/152, 154, 211; 169/75, 88

[56] References Cited

U.S. PATENT DOCUMENTS

| | | | |
|---|---|---|---|
| 596,379 | 12/1897 | Pates | 116/77 |
| 824,161 | 6/1906 | Wade | 116/83 |
| 2,302,963 | 11/1942 | Lefever | 222/39 |
| 3,228,565 | 1/1966 | Stanzel | 222/82 |
| 3,230,912 | 1/1966 | Hohimann | 109/20 |
| 3,353,749 | 11/1967 | Lahaug | 222/78 |
| 3,830,404 | 8/1974 | Frazier | 222/78 |
| 4,058,237 | 11/1977 | Luke | 222/175 |

*Primary Examiner*—H. Grant Skaggs
*Attorney, Agent, or Firm*—Charles W. Helzer

[57] ABSTRACT

A personal protective device for repelling intruders comprising an exterior housing member of attractive appearance designed to be worn, secured to, appended from or otherwise conveniently carried on the person of a human being in the normal manner of a piece of jewelry. The housing member includes a fluid container for storing and dispensing a quantity of fluid as a spray jet. The intruder repellant fluid is completely and safely sealed within the dispenser container until the device is willfully actuated in order to fend off and mark an intruder by an offensive odor and distinguishing color.

10 Claims, 22 Drawing Figures

Fig. 1.
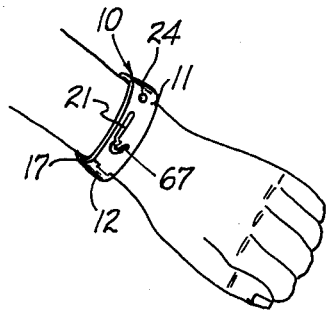
Fig. 2.
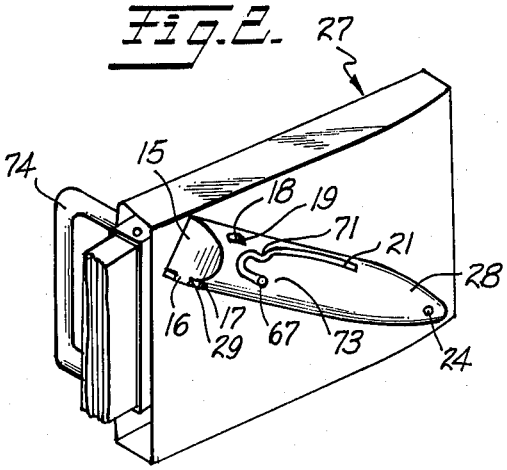
Fig. 3.
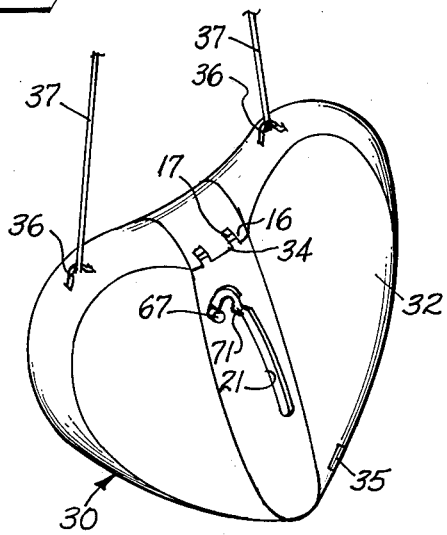
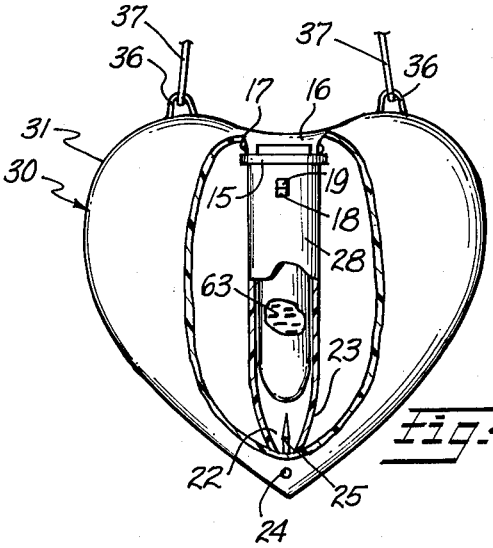
Fig. 4.
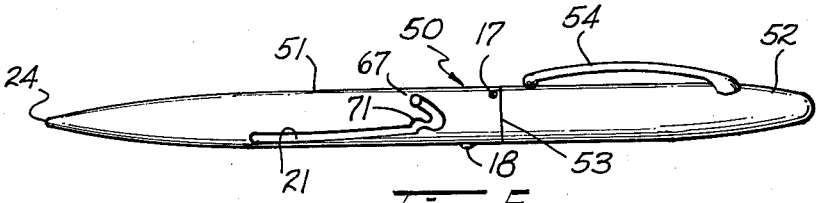
Fig. 5.

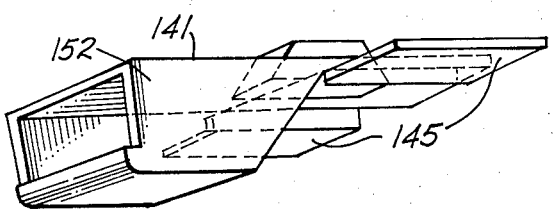
Fig. 15.
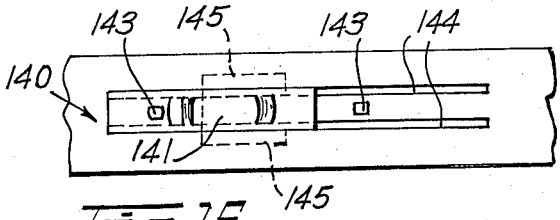
Fig. 16.
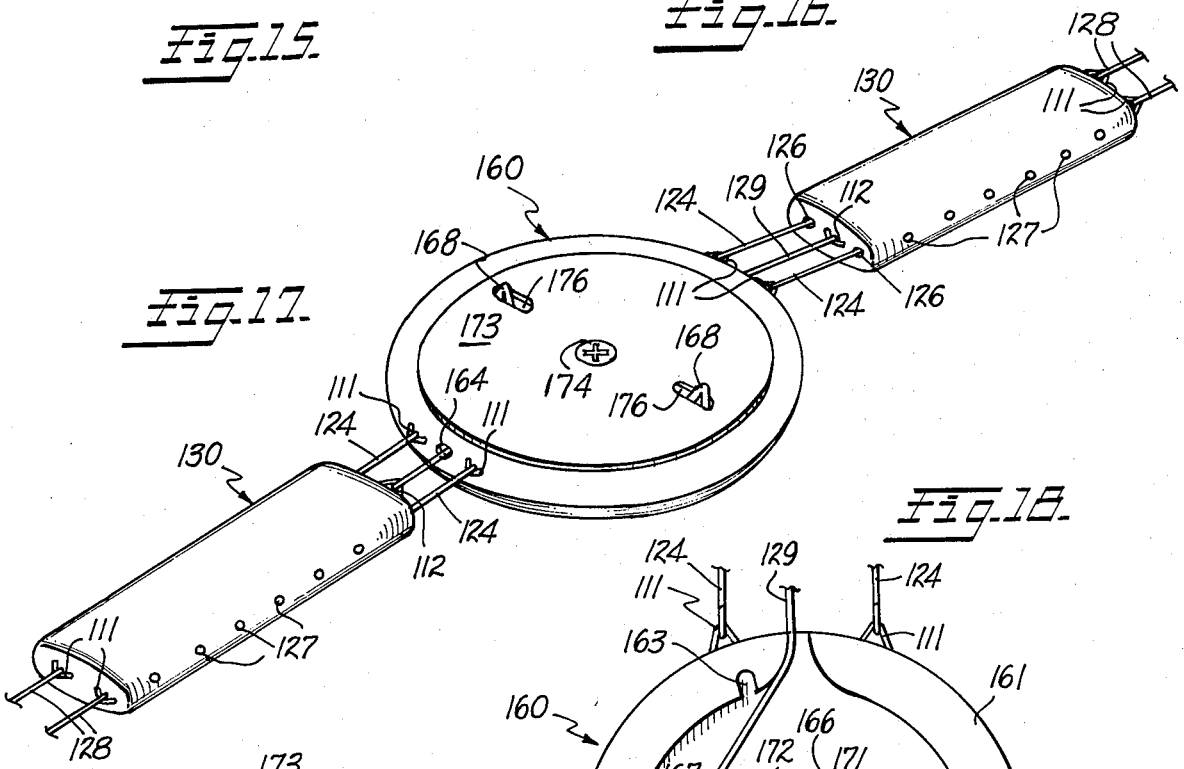
Fig. 17.
Fig. 18.
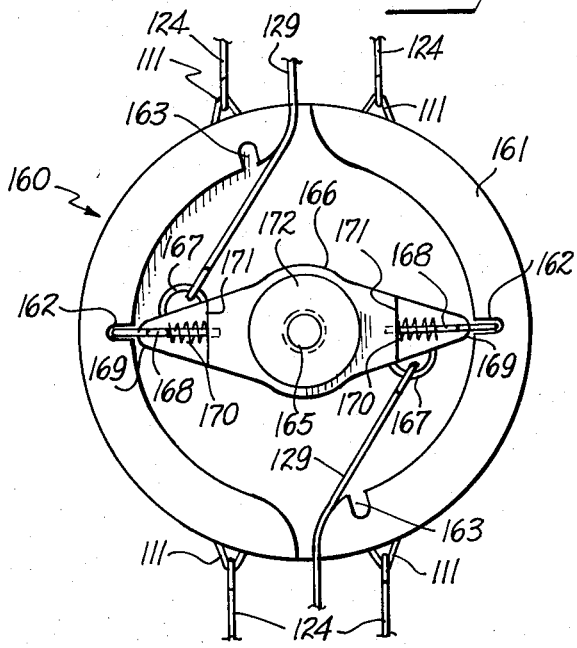
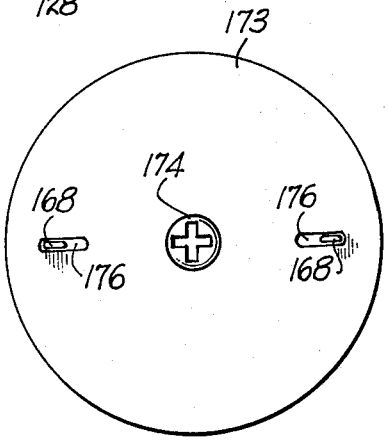
Fig. 20.
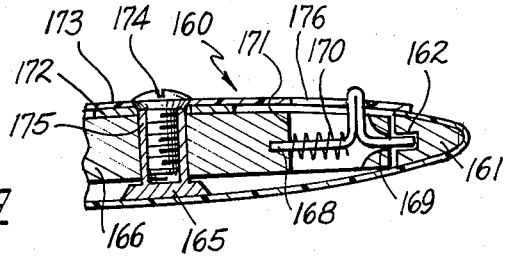
Fig. 19.

PERSONAL PROTECTIVE DEVICE

This is a continuation of application Ser. No. 633,124, filed Nov. 18, 1975 and now abandoned.

BACKGROUND OF INVENTION

1. Field of Invention

This invention relates to a personal protective device for use by an individual in warding off or discouraging attack by an intruder.

More specifically, the invention relates to a protective device which can be worn or carried on the person of an individual in the manner of a piece of jewelry or article of clothing, etc., and which upon selective operation by the wearer, ejects a fluid substance of foul and repulsive odor and which also may be colored. The substance serves to mark a prospective attacker both with the repulsive odor and a colored dye mark so that he knows that he can later be identified and thus may be discouraged from pursuing an otherwise intended attack. The fluid substance is harmless and later can be washed off but only with effort and only with suitable washing facilities and cleansers.

2. Prior Art Situation

Historically a number of products have been available to individuals for self defense purposes which range from such items as hand guns, knives, black jacks and the like to the more recently introduced products such as the MACE gas dispenser. Each of these products has certain short comings such as the requirement for special licenses from police authorities, physical strength and adroitness on the part of the user, etc. With respect to the MACE gas dispenser, this item is packaged in the form of an aerosol can which is bulky and unsightly, and normally (if used) is carried within a hand bag, etc. so that it is not readily available if a surprise attack occurs. In order to overcome these deficiencies of the prior art personal protective devices, the present invention was devised.

SUMMARY OF INVENTION

The personal protective device made available by the present invention comprises a light-weight, easily transportable exterior housing member of attractive appearance that simulates a basic piece of jewelry or other article designed to be worn, secured to, appended from or otherwise conveniently carried by an individual in a readily accessible manner similar to a piece of jewelry. The exterior housing member includes a container for a fluid substance of foul and repulsive odor together with a valving arrangement for emitting or forcibly ejecting the odorous fluid in a spray jet against an attacker. These parts are designed as an integral portion of the basic piece of jewelry or article in a manner such that the device is both decorative and inconspicous and disguises the purpose of the device. The fluid container serves as a convenient reservoir for the fluid substance of foul and offensive odor and also includes a safety lock means for preventing inadvertent release of the fluid from the device, but which may be readily armed and thereafter selectively operated by the wearer for use against an attacker. In the event an attack does not occur and the device is not used, it may be returned to the safety locked condition.

In practicing the invention, a personal repellant protective device is provided which comprises an exterior housing member of attractive and inconspicous appearance. The housing member includes a container for a fluid substance of foul and repulsive odor and at least one outlet opening to the exterior which communicates with the container for the fluid. Selectively actuated valve means coact with the container for releasing the fluid substance through the outlet opening under the control of a person wearing the device. The device is completed by safety lock means on the housing member for positively preventing inadvertent action of the selectively actuable valve means with the safety lock means being selectively operable by a person wearing the device under situations where it is desirable to arm the device and condition it for operation through the medium of the selectively actuable valve means. The container preferably is filled with a fluid substance of a foul and repulsive odor which also is colored so that upon release and contact with an attacker, the attacker will be marked both by a foul odor and a readily identified, visually observable mark. The fluid substance of foul odor preferably is ejected under pressure in the manner of an aerosol spray and may be accompanied by a loud noise intended to startle a prospective attacker. Alternatively, the fluid substance may be emitted in a slow flowing or oozing manner so that the attacker is not aware that he is being marked until it is an accomplished fact.

BRIEF DESCRIPTION OF DRAWINGS

These and other objects, features and many of the attendant advantages of this invention will be appreciated more readily as the same becomes better understood by reference to the following detailed description, when considered in connection with the accompanying drawings, wherein like parts in each of the several figures are identified by the same reference character, and wherein:

FIG. 1 is a perspective view of a personal protective repellant dispensing device constructed in accordance with the invention and fabricated in the form of a bracelet or watch band to be worn upon a person's wrist;

FIG. 2 is a perspective view of an embodiment of the invention fabricated in the form of a belt buckle or brooch;

FIG. 3 is a perspective view of a third embodiment of the invention fabricated in the form of a pendant or locket on a necklace;

FIG. 4 is a front elevational view in partial section of FIG. 3;

FIG. 5 is an elevational view of a fourth embodiment of the invention fabricated in the form of a conventional fountain pen for wearing in the pocket of an individual;

FIG. 15 is a perspective view of a slide safety catch employed with the safety locking unit of FIG. 14;

FIG. 16 is a partial side elevational view of the safety catch unit of FIG. 14 showing the relative location of the slide safety switch member, switch spring detents and switch guide slots for the slide safety catch element;

FIG. 17 is a partial, plan perspective view of a second embodiment of the form of the invention shown in FIG. 11 and which employs a different type of safety catch unit that utilizes a rotating release switch element;

FIG. 18 is a sectional plan view of the rotatable safety switch element employed with the embodiment of the invention shown in FIG. 7;

FIG. 19 is a partial side sectional view of the rotatable safety catch element shown in FIG. 18; and FIG. 20 is a plan view of the rotatable safety catch unit cover plate and showing the slots through which access to rotor lock pins is provided whereby a wearer of the belt or necklace readily may set the device to an armed or ready condition.

DETAILED DESCRIPTION OF PREFERRED EMBODIMENTS

Figure 6:
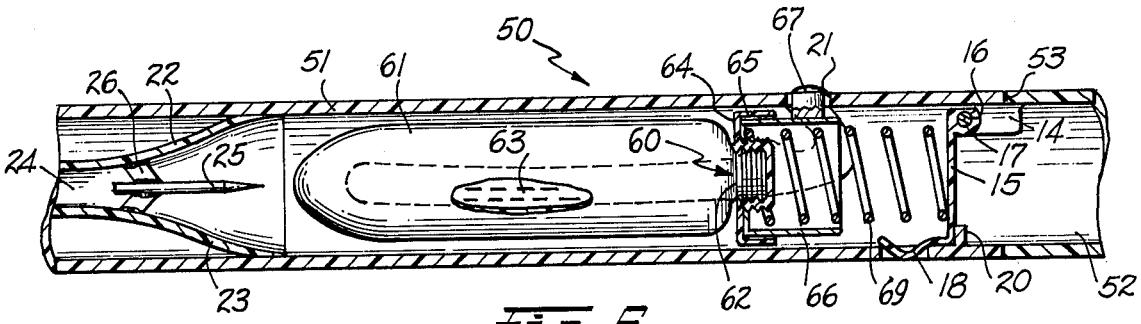
FIG. 6 is a partial sectional view of the interior components of the personal protective repellant dispensing device which components may be mounted in any one of the embodiments of the invention shown in FIGS. 1–5, and wherein the components are shown in a safety or unused condition.

FIG. 1 of the drawings illustrates an embodiment of the invention which has been fabricated in the form of a wrist bracelet 10 and which includes a fluid repellant dispensing element as an integral part of the bracelet. Thus it will be appreciated that the device is inconspicous and may be worn by an individual for use when attacked for his or her personal protection. The bracelet is fabricated in two parts, generally ndicated by the numerals 11 and 12, which are hinged together by a hinge pin 17 passing through mating hinge portions of the bracelet as will be described more fully hereinafter with respect to FIGS. 6–8B of the drawings.

FIG. 2 is a perspective view of a belt buckle or brooch which includes a fluid repellant dispensing device constructed in accordance with FIGS. 6–8B. FIGS. 3 and 4 illustrate a locket which includes the fluid repellant dispensing device of FIGS. 6–8B; and FIG. 5 is a perspective view of a fountain pen embodiment of the invention which likewise includes a fluid repellant dispensing device constructed in accordance with FIGS. 6–8B.

In each of the embodiments of the invention shown in FIGS. 1–5, a fluid repellant which has a foul and repulsive odor similar to that of a skunk, for example, is ejected forcibly from an outlet opening or nozzle 24 upon actuation of the device by the wearer. The foul and repulsive fluid substance also preferrably is dyed with a bright color such as red and is emitted from the outlet opening or nozzle 24 at a relatively high velocity so as to spray all over a prospective attacker. It is anticipated that the marking of an attacker both with the foul and repulsive odor and with a brightly colored, easily viewed and identifiable color marking, will dissuade the attacker from his intended purpose. The fluid repellant otherwise is harmless and may be washed off but only with considerable effort and with the assistance of suitable washing facilities and cleansing solutions. Any prospective attacker who has thus been marked, hopefully then will change his mind and purpose from that of attacking a person to a different purpose, namely of cleaning himself up and ridding himself of the smell and color marking so as not to be apprehended.

For convenience, the structural arrangement of the fluid repellant dispensing device has been illustrated in FIGS. 6–10 for use in conjunction with the embodiment of the invention shown in FIG. 1. It will be appreciated, however, that the device readily may be incorporated in any other of the embodiments shown in FIGS. 2–5, or for that matter in any other suitable article which is worn or carried by an individual and is readily accessible, similar to a piece of jewelry, and which disguises its intended purpose. The bracelet 10 of FIG. 1 is constructed of the two essentially tubular parts 11 and 12 which may be fabricated of semi-precious metal or other costume type material. Each of the tubular parts 11 and 12 are hinged together at 17 to form a closed circular wrist bracelet for adorning a person's wrist. The elements comprising the fluid repellant dispensing mechanism are contained within the tubular part 11 and are comprised by a liquid container cartridge unit 60 formed by a cartridge or ampule 61 fabricated from a light, flexible plastic or rubber material fused together with a threaded cartridge filler neck 62 of suitable plastic or hard rubber construction. The cartridge filler neck 62 is provided with external threads for connection to a filling machine so that the cartridge or ampule may be filled with a suitable liquid repellant (indicated at 63) having a foul and repulsive odor and which preferably also is colored with a bright dye of red, yellow, orange or other comparable, readily viewed marking color.

The liquid repellant 63 may be in the form of a synthetic essence of skunk odor which may be composed by mixing the secretion from a skunk with a suitable liquid carrier such as alcohol. Another substance would be civet in its pure form also mixed with alcohol or some similar carrier. It is anticipated that the odorous substance in liquid form could by itself be employed to fill the ampule or cartridge 61. However, it is preferred to mix the odorous substance with a suitable aerosol propellent such as flourinated hydrocarbon, freon gas, carbon dioxide or nitrogen gas in a mixture which can be constrained within the frangible plastic or rubber ampule cartridge 61 while supported by the walls of tubular part 11.

Figure 9A:
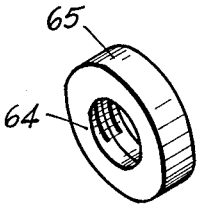
FIG. 9 is a perspective view of the safety closure element employing a safety guide pin and flange and comprising a part of the components shown in FIGS. 6–8B.
Figure 9B:
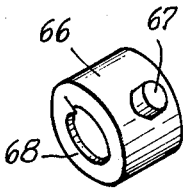

The liquid container cartridge unit 60 is the replaceable element of the device and includes an internally threaded cartridge cover 64, the construction of which is shown more clearly in FIG. 9A. The cartridge cover 64 includes a cup-shaped internally threaded neck portion which coacts with the externally threaded cartridge filler neck 62 to sealingly close the ampule or cartridge 61 after it has been filled. Both the cartridge or ampule 61, filler neck 62 and cartridge cover 64 preferably are formed of a light flexible plastic of a type which may be fused together at the threads by the touch of a hot fusion iron following the filling of the cartridge 61 with the repellant liquid 63 so as to assure a liquid tight seal by the closure member. In this manner, the liquid repellant 63 is securely contained within the cartridge 61 till used.

Integral with the cartridge cover 64 is a cartridge cover flange portion 65 which, as will be explained later, also serves as a piston surface and includes a skirt portion that serves as a bearing and sealing surface for the entire cartridge unit 60 upon the device being activated to dispense the liquid repellant. The bearing surface of the flange and skirt portion 65 is shaped such as to provide a loose seal in a slidable contact with the appropriate internal surface of tubular part 11.

Figure 7:
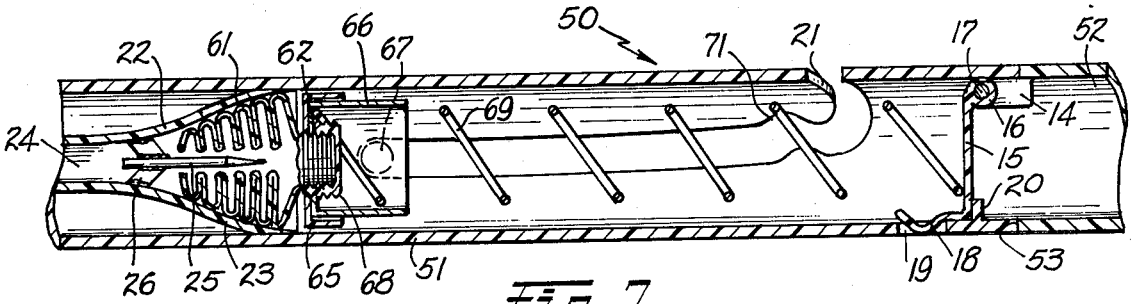
FIG. 7 is a partial sectional view of the components of the personal protective device shown in FIG. 6, and illustrates the components in an expended condition after ejection of a spray of fluid of foul and repulsive odor.

The tubular part 11 also contains a safety closure guide pin activation guide way 21 best seen in FIG. 7 of the drawings. This guideway 21 serves to constrain the movement of a safety closure guide pin 67 integral with the cartridge cover 64 to cause it to follow a particular line of movement defined by guideway 21. As will be seen in FIG. 9B, the guide pins 67 are formed as an integral part of a safety closure member 66 which includes a central self-tapping cup-shaped threaded central portion 68 for threadably receiving and retaining the threaded end of the sealed ampule and cartridge cover 64. As will be seen in each of FIGS. 6–10, the flange or skirt portion 65 of the cartridge cover 64 extends out and over a similar-shaped flange or skirt portion of the safety closure member 66 but stops short of the integral guide pin 67. By this arrangement, the internally threaded portion 68 of the safety closure member 66 can be screwed down over the projecting threaded filler neck portion 62 of ampule 61 and the fused together cartridge cover 64 to thereby link together the safety closure member 66 and liquid container cartridge 61 and form a complete moveable piston-like unit 60 within the dispensing device. To facilitate insertion of the piston unit 60 within the tubular member 11, two small slots may be formed on either side of the safety closure guide pin 67 in safety closure member 66. Such slots may not be necessary if the safety closure 66 is fabricated of a suitable flexible metal material which also must have sufficient stiffness to prevent the safety closure guide pin 67 from receding out of the safety closure activation guideway 21.

A helical compression drive spring 69 is seated within the confines of the tubular portion 11 with one end of the spring 69 in abutting contact with the interior surface of the flange portion of safety closure member 66 and with the remaining end of the spring contacting the interior side of a safety catch end cover 15. The safety catch end cover 15 retains the spring 69 within the tubular bracelet member 10 in the compressed condition when the bracelet 10 is opened for donning or removal from the wearer's wrist. Safety catch end cover 15 has an integral part which is coaxial with the hinges of the bracelet and is hinged thereto through the medium of the hinge pin 17. When closed, the safety catch end cover 15 is in abutting contact with the bracelet tubular member half 11 to provide compressive engagement of a safety catch end cover latch 18 within a retention slot 19 formed in tubular member 11. A safety abuttment 20 is formed in the opposite half 12 of the bracelet to act as an additional restraint for the safety catch end cover 15 when the bracelet is in the closed condition. From FIGS. 6 and 7, it will be seen that the drive spring 69 will be in compression at all times and tends to maintain the guide pin 67 driven into its closed safety position as shown in FIG. 6 and FIG. 8B of the drawings at all times.

Figure 10:
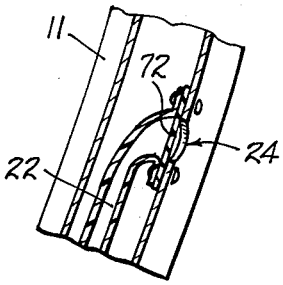
FIG. 10 is a partial sectional view of an outlet or nozzle portion of the device showing the manner in which a noise maker may be attached to and comprise a part of the device.

The liquid repellant dispensing device further includes within the interior of the tubular member 11 a nozzle 22 which, as shown in FIG. 10, communicates with an outlet opening 24 and further includes a flange portion 23 that is welded, brased, soldered or otherwise secured to the interior surface of the tubular member 11. A puncture pin 25 is supported within the nozzle 22 by means of a spider support 26 with the pin 25 aimed at the end of the repellant liquid container ampule 61.

The repellant liquid 63 contained within the ampule 61, upon operation of the device, is forced to enter the nozzle 22 by the piston-like action of the piston-like structure comprised by cartridge cover 64 and safety closure member 66. The liquid repellant is forced out through nozzle 22 and out of opening 24 through the expanding action of the drive spring 69. Activation of the device is accomplished by manually overcoming the compressive force of the drive spring 69 through finger pressure on the safety closure pin 67 which is sufficient to overcome the compressive force of drive spring 69. In this manner the safety guide pin 67 is moved from the safety position shown in FIGS. 6 and 8B to the ready or armed position shown in dotted outline form at 71 in FIG. 7. At 71 a slight dimple or constriction is formed in guideway 21 which is just sufficient to constrain guide pin 67 against movement by drive spring 69. With the guide pin thus positioned, all that is needed is a very slight push of the guide pin 67 in the direction of puncture pin 25 to cause it to be released to the action of drive spring 69. Upon this occurrance, drive spring 69 drives the ampule 61 toward the left as viewed in FIG. 6 to cause it to be smashed against the puncture pin 25 and be punctured. Continued expansion of drive spring 69 will then force the liquid repellant out through nozzle 22 and outlet 24 with sufficient force to spray on any attacker towards whom the device is directed. To assure a positive squirting action, the skirt portion 65 of cartridge cover 64 and the skirt portion 66 of the safety closure member form a positive sliding seal against the inside surface of the tubular member 11.

Upon operation of the liquid repellant dispensing device in the above described manner, it is anticipated that some air will be trapped in the nozzle 22 between ampule 61 and outlet 24. Outlet 24 may include a very thin, frangible member of balloon like thinness shown at 72 which normally sealingly closes the outlet 24. Upon release of the liquid repellant in the above described manner, the entrapped air in nozzle 22 will first inflate and then audibly burst the frangible member 72 so as to produce a loud popping noise. This noise, when accompanied with spraying of the skunk-like odor colored substance, is designed to frighten the attacker against whom the dispensing device is directed. The fright thus induced accompanied by the physchological effect of being sprayed with a skunk-like odor colored substance, is calculated to dissuade even the most insistent of attackers. In the case of a potential rapist, it is anticipated that this treatment alone will be sufficient to disuade the rapist and direct his attention away from sex towards cleanup.

Figure 8A:
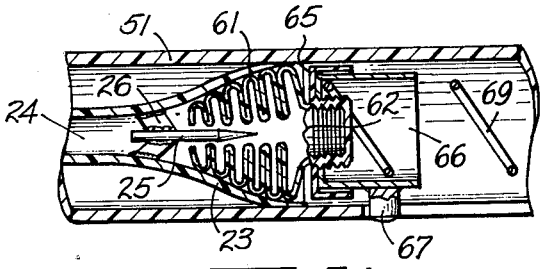
FIG. 8A and FIG. 8B are partial sectional views taken through different planes of the internal component of the device as shown in FIGS. 6 and 7 and illustrate the device in both the armed and ready condition and in a subsequent expended condition.
Figure 8B:
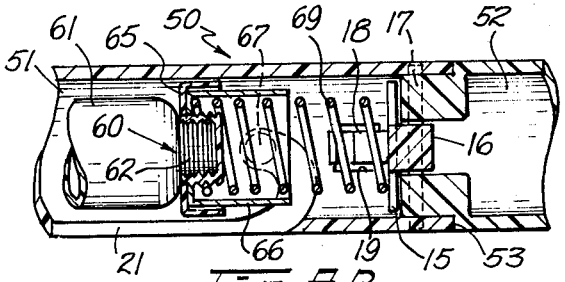

FIGS. 7 and 8A of the drawings illustrate the dispensing mechanism in the post activated condition. From a comparison of these figures to FIGS. 6 and 8B, it will be appreciated that a considerable volume of liquid will be dispensed through the action of the drive spring 69 alone. However, in a preferred embodiment of the invention, a suitable propellent gas is included in the liquid repellent ampule 61 for providing additional force to the spray of repellent fluid that is emitted from the outlet opening 24. The propellent gas, if included, also will serve to rupture the frangible diaphragm 71 with greater force so as to increase the loudness of the bang that is produced when the device is operated. It should be noted that when the device is adjusted to its safety condition, the power of the compression drive spring 69 against the back surfaces of the safety sealing member 66, serves to firmly drive the safety closure guide pin 67 into the end of the U-shaped cane handle portion of the activation guideway 21 configuration formed in tubular member 11 so that there is no conceiveable way that the device will be released inadvertently. A positive force must be applied to the guidepin 67 against the force of compression spring 69 to lift pin 67 from the end of the U-shaped guideway configuration where it seats in the safety condition, as shown in FIG. 6, around to the ready armed condition shown in dotted outline form at 71 in FIG. 7. From the position shown in 71, the guidepin 67 easily may be released by only a small force applied by the wearer. It is anticipated that when a wearer of the device discovers himself to be in a somewhat dangerous situation, he or she would move the safety guidepin from the safety locked position shown in FIGS. 6 and 8B to the ready armed condition shown at 71 in FIG. 7. Thus the device will be conditioned for ready and easy use in the event of an attack by an intruder. If no attack occurs, the device can be returned to the safety condition by a similar but opposite movement of guidepin 67. Thus it will be appreciated that the guide pin 67 constitutes part of a selectively controllable dispensing means under the control of the wearer which when released from the ready armed detent position shown at 71 in FIG. 7, operates in conjunction with drive spring 69, skirt portions 65 and puncture pin 25 to force fluid from ampule 61 out through outlet opening 24 of container 11 in the form of a jet spray.

In the embodiment of the invention shown in FIG. 2, a belt buckle 27 or brooch is employed to disguise the repellent dispensing device. In this embodiment of the invention, a liquid dispensing container 28 is secured within the brooch or buckle and a small hinged cover plate 15 is provided to serve as a backing member and is similar to the safety catch end cover 15 employed in the embodiment of the invention shown in FIGS. 6 through 8B. The safety end cover 15 is forcibly rotated about a hinge pin 17 and may include a safety catch end cover latch 18 that cooperates with a latch retention slot 19 formed in the tubular member 28. Tubular member 28 serves in the same manner as tubular member 11 of the embodiment shown in FIGS. 6–8B. Operation of the liquid dispensing device is initiated by first forceably moving the safety closure guide pin 67 against the action of spring 69 from its safety locked position to the ready armed position shown in dotted outline at 71. Only finger action then is required to release the guide pin from the ready armed detent position shown in 71 to cause ejection of the liquid repellent. If in fact, no danger is encountered, the device then may be returned to the safety locked position without requiring replenishment of the repellent liquid. However, if the guide pin is released from the ready armed position shown at 71, the repellent liquid will be forcibly ejected from the nozzle outlet 24 in the same manner described with relation to the embodiment of the invention shown in FIGS. 6–8B.

The brooch or buckle shown in FIG. 2 preferably includes a small eyelet or circular enclosure 73 secured to guide pin 67 and a clasp or other means of detachable securement shown at 74. With this means, the brooch may be secured to the dress or coat of an individual, a belt or to a handbag, interchangeably. When the wearer is going into areas where purse snatching is prevalent, they can tie a string to the eyelet 74 on guidepin 67 with the brooch being secured to their purse and the other end of the string secured to their person. With the guide pin set to the ready armed position, the device automatically will be activated in the event of a purse snatching.

In the embodiment of the invention shown in FIGS. 3 and 4 of the drawings, a locket or pendant 30 is employed to incorporate the liquid repellent dispensing device, and has the appearance of a normal article of jewelry. As shown in FIG. 3, locket 30 is composed of a heart-shaped front part 31 that is hinged to a back part 32 by means of a hinge pin 17. A conventional jewelers snap lock 35 serves to hold the assembly together with the back part closed on the front part. Locket support eyelets 36 are attached to the locket 30 to engage a ribbon or fine chain for supporting the locket 30 about the wearer's neck.

As shown in FIG. 4, a tubular liquid container 38 is supported within the locket with the repellent liquid containing ampule 61 supported within tubular member 38. The tubular member 28 includes the safety closure guide pin activation guideway 21 in which is supported the safety closure guide pin 67 as described previously. The safety catch end cover 15 is shown in abutting contact with the open end of the tubular container member 38 and is maintained in a closed condition by the action of a safety end cover latch 18 coacting with a retention slot 19 formed in the wall of the tubular container member 38. The puncture pin shown at 25 is supported within a nozzle outlet 22 communicating with outlet opening 24 in a manner similar to that shown in FIGS. 6–8B. To operate the embodiment shown in FIGS. 3 and 4, the safety guide pin 67 is first moved from the safety locked position shown in FIG. 3 to the dotted outline ready armed detent position shown at 71 where it then readily can be released with only finger action to eject a liquid repellent on a prospective attacker.

The fourth embodiment of the invention shown in FIG. 5 is fabricated in the form of a pocket pen, and is but a slight modification of the bracelet embodiment shown in FIGS. 6–8B. In the pocket pen device 50, the basic tubular construction is composed of the bottom member 51 of the simulated fountain pen device 50 and a top member 52. The two members are held together in threaded engagement by a standard pen screw thread joint. The top member 52 has a spring clip 54 to permit the pen to be carried in a persons coat in the normal manner of a fountain pen. A hinge pin 17 is shown passing through the bottom member to provide for attachment of a safety catch end cover (not shown in FIG. 5) and including a safety catch end cover latch 18 cooperating with a suitable slot in the lower member 51.

A safety closure guide pin activation guideway 21 is formed in the lower member and slideably seats the safety closure guide pin 67 in the same manner as previously described in embodiments of the invention. Within the body member 51, a nozzle flange connects a suitable nozzle to an outlet opening 24 in the end of the fountain pen device. This configuration permits the repellent liquid dispensing device to be held in the hand of the owner and facilitates aiming of the repellent liquid to be ejected onto a prospective attacker. In other respects, operation of the fountain pen configuration is entirely similar to that described with respect to other embodiments of the invention.

Figure 11:
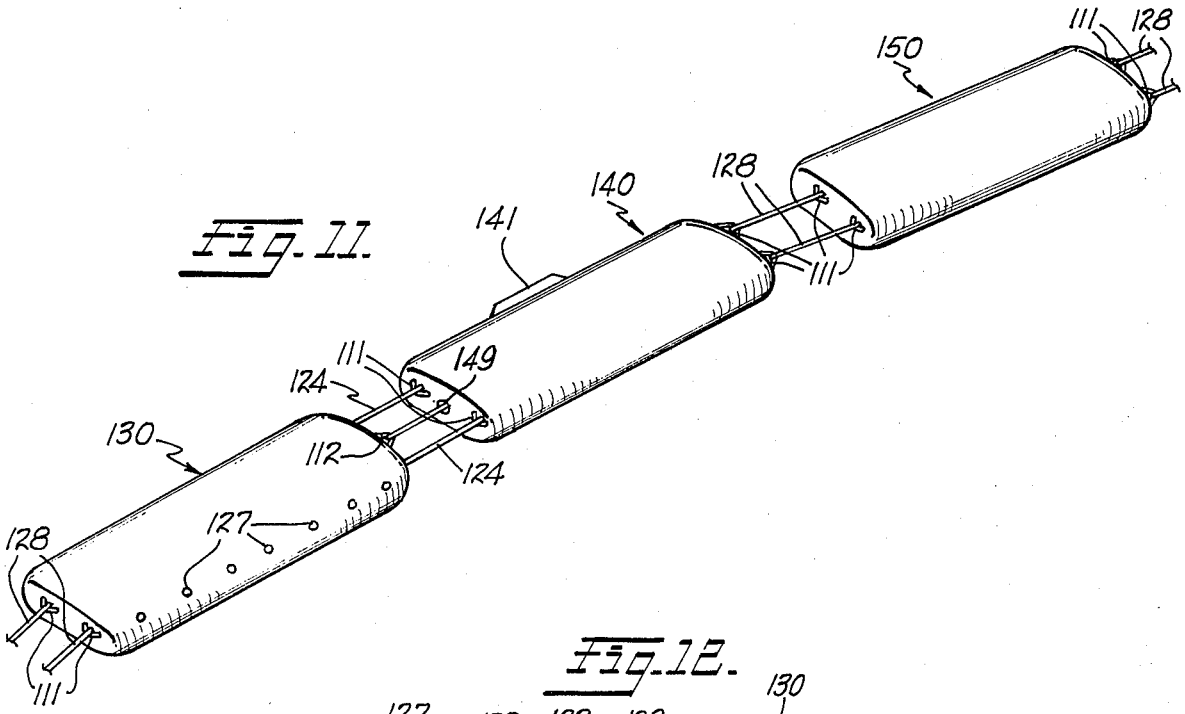
FIG. 11 is a perspective view of an assembled necklace or belt fabricated in accordance with the invention and wherein certain of the link elements of the necklace or belt comprise a container and liquid repellant dispensing component and other link elements comprise a safety lock unit.

The embodiment of the invention shown in FIG. 11 may comprise a jewelry necklace or alternatively a belt in which the liquid repellent dispensing device is incorporated as an integral part of the article. For convenience, the article will be treated as a belt and makes available an embodiment of the invention for dispensing liquid repellent onto an intruder who is in physical contact with the wearer of the device. This embodiment of the invention is for use under circumstances where the wearer has been taken completely by surprise and was unable to arm and use one of the embodiments of the invention described in FIGS. 1–10. With the embodiment of the invention shown in FIG. 11, it is anticipated that an intruder or attacker will be physically wrestling with the wearer of the device in such a manner that the liquid repellent dispensed from the device not only will be marked on the attacker but of necessity also leaves its mark on the wearer.

The embodiment of the invention shown in FIG. 11 is comprised of a plurality of uniformly appearing links such as 130, 140 and 150 which are of standardized but attractive appearance so as to appear to be standard component parts of a belt design. The links 130, 140 and 150 as well as other links comprising the belt or necklace, are interconnected through chains or cords 128 attached to eyelets 111 formed at the end of each of the links. A suitable buckle such as the one illustrated in FIG. 2 may be provided for the belt. In addition, at one or more locations around the circumference of the belt, certain of the links such as 130 and 140 are specially designed to incorporate respective liquid repellent dispensing device and safety catch mechanisms.

Figure 12:
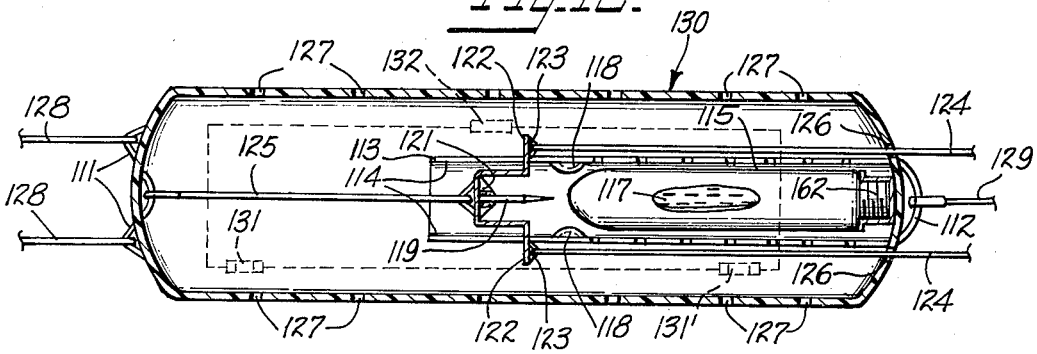
FIG. 12 is a sectional plan view of one of the elements of the belt or necklace shown in FIG. 11 having the fluid repellant dispensing device contained therein.
Figure 13:
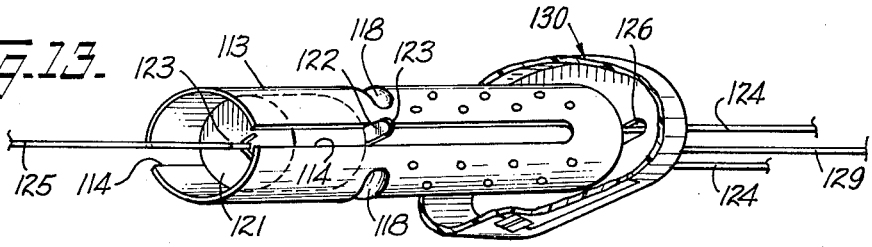
FIG. 13 is a partial perspective view illustrating the construction of a perforated tubular member comprising the fluid repellant dispensing device shown in section in FIG. 12.
Figure 14:
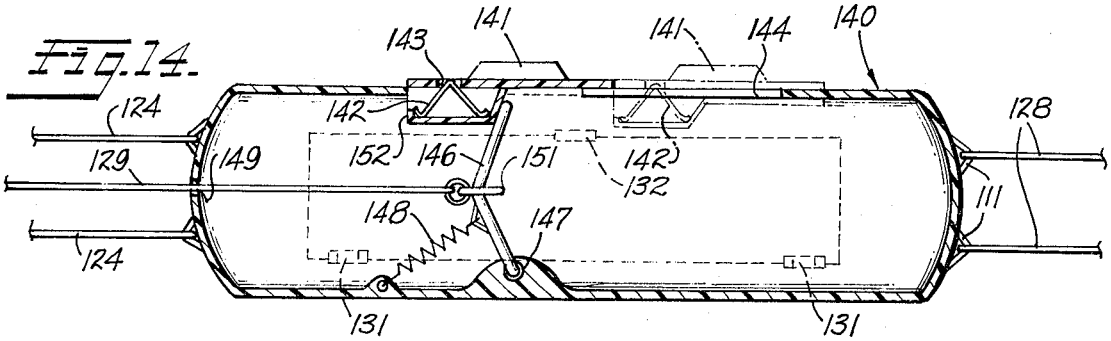
FIG. 14 is a sectional plan view of one of the link elements of the belt or necklace shown in FIG. 11 and illustrates the safety lock component comprising a part of the overall personal protective device of FIG. 11.

FIG. 12 is a sectional plan view of the construction of one of the liquid repellent dispensing links 130 which is interconnected in the belt or necklace through the medium of the cords 128, 124 and 129. The cord or cable 129 is secured to the right hand end of link 130 through the medium of a safety cable eyelet 112. The link 130 is comprised by a relatively flat, semielliptically-shaped housing member having a number of perforations 127 formed in its outer surface and a pair of egress openings 126 provided at the same end to which the safety cable eyelet 112 is secured. The openings 126 allow for the passage of a pair of activation cords 124 secured at one end to the link 140, as shown in FIG. 14, and having their remaining end secured to a set of eyelets 123 formed on the opposite ends of a safety pin guide arm 122. The safety pin guide arms 122 are designed to ride within a pair of parallel, oppositely positioned, longitudinal guide slots 114 formed in opposite sides of a perforated guide tube 113 best shown in FIG. 13 and secured within link housing member 130. The perforated guide tube 113 at one end has an internally threaded cup-shaped receptical 162 secured for threadably receiving the externally threaded neck of a repellent liquid container ampule 115 similar in construction to that described with relation fo FIGS. 6–10. The safety guide pin arms 122 comprise an integral part of a moveable, cup-shaped puncture pin support 121 which rigidly supports a puncture pin 119. A set of cartridge restraint and sealing identations of generally flexible construction are shown at 118 and are integrally formed in perforated guide tube 113 intermediate the puncture pin structure 119 and the end of the liquid repellent ampule 115.

The puncture pin support 121 has a safety cable eyelet 123 secured to the side thereof opposite puncture pin 119. One of a safety cable or cord 125 is secured to the safety cable eyelet 123 and the remaining end of the safety cord 125 is secured to an eyelet 111 formed in the opposite end of the outer housing member 130. To provide access to the interior of the outer housing member 130 and allow an owner of the device to change or insert new ampules as well as safety cords after use of the device, a hinged panel or door is provided as shown in dotted outline form in FIG. 12 and is secured in place by the hinges 131 and snap lock 132 similar in construction to those generally employed in jewelry box design.

It will be appreciated from FIGS. 12 and 13 that upon the device being suitably armed for use (as will be described more fully hereinafter) and the wearer tugging upon the activation cords 124 with sufficient strength to break the safety cord 125, the puncture pin assembly 121 can be caused to slide along the guide slots 114 in perforated tube 113 and to puncture the liquid repellent ampule 115. In doing so, the puncture pin assembly 121 will pass by the restraint and sealing indentations 118 so as to act as a piston and cause the liquid repellent 117 to flow slowly or ooze out through the perforations in perforated tube 113 and the perforations 127 in the outer housing member 130 to thereby contact an intruder or attacker who may be wrestling with the wearer of the device.

FIG. 14 is a sectional plan view of a safety catch unit link 140 which is included in the belt or necklace in a position adjacent to the liquid repellent dispensing link 130. The safety catch link 140 has the standard eyelets 111 formed at each of the ends thereof for connection to the interconnecting cords 128 and the activation cords 124. The safety catch unit link 140 is comprised by an outer metallic or plastic member similar in configuration to the link 130 housing member and has a hinged opening back cover secured to it by hinge members 131 and snap lock closure 132 for providing access to the interior of the link unit. A safety cable egress opening 149 is provided in the left hand end of safety link unit housing member 140 through which the safety cable 129 passes. Recall that one end of the safety cable 129 is attached to the safety cable eyelet 112 on the liquid repellent dispensing unit link 130 as shown in FIG. 12. The remaining end of safety cable 129 passes through access opening 149 in link unit 140 and is attached to an annular eyelet 151. In the safety lock condition, the central opening in annular eyelet 151 is threaded by a pivoted safety cable lever arm 146 hinged to the safety catch unit housing member 140 at 147. A safety lever arm biasing spring 148 is secured to safety lever arm 146 and to housing member 140 and normally biases lever arm 146 in a direction to cause it to move counterclockwise from the position shown in FIG. 14.

The free end of the safety cable lever arm 146 normally is restrained in the safety condition by a safety switch 141 whose construction is better shown in FIGS.

15 and 16 of the drawings. Safety switch 141 normally is maintained in its leftmost position shown in FIG. 14 by the action of lever arm 146 against the tapered front face of a depending detent portion 152 of safety switch 141. To further restrain the safety switch 141 in its leftmost position shown in solid outline form in FIG. 14, a detent spring 142 is mounted within the detent portion 152 of the switch assembly and coacts with a detent opening 143 in the link unit outer housing as shown in FIGS. 14 and 16. The safety catch unit is changed from its safety lock condition shown in solid line FIG. 14 to the armed or ready condition by merely sliding the safety switch 141 from its solid line position to the right to its dotted line position shown in FIG. 14. To accommodate this movement, switch guide slots 144 are formed in the upper surface of the unit housing member 140 along with the detent openings 143.

In operation, the liquid repellent dispensing device shown in FIGS. 11–16 normally will be maintained in its safety lock condition as shown in solid line in the drawings. Upon sensing danger, or otherwise entering a dangerous area where attack might occur, the wearer of the device will slide the safety lock switch 141 to its dotted line position shown in FIG. 14. In doing so, the tapered front face of the detent portion 152 of safety switch 141 will slide over the end of safety lever arm 146 because of the resilience provided to the lever arm by safety spring 148. Upon the safety switch 141 reaching its dotted outline position, it will be retained there by the detent spring 142 and lever arm 146 will be allowed to pivot counterclockwise from the position shown in FIG. 14 thereby allowing the safety eyelet 151 to slip over its free end and release the safety cable or cord 129. In this manner, the liquid repellent dispensing device will be conditioned in the armed or ready configuration.

After being conditioned to the armed or ready configuration as described in the preceeding paragraph, the wearer may then selectively actuate the liquid repellent dispensing device by tugging or pulling on the activation cords 124. The device is designed in such a manner that the basic interconnecting link chains or cords 128 are of sufficient size to sustain a tension force of approximately 20 lbs. each. The activation cords 124 are sized to sustain a tension force of approximately 10 lbs. each while the safety cable 129 is sized to be capable of sustaining a tension force of approximately 25 lbs. However, the restraint cord 125 in the liquid repellent dispensing unit 130 is designed to sustain a tension force of approximately only 10 lbs. Thus, the restraint cord 125 is the weakest link in the belt or necklace. With the belt or necklace in the ready or armed condition as described above, the application of a pulling or tugging on the activation cords 124 or for that matter any location of the belt or necklace which results in a tension force of greater than approximately 10 lbs., will cause failure of the restraint cord 25. With the restraint cord 25 broken by such pulling or tugging action, continued application of the pulling or tugging on the belt will cause the activation cords 124 to pull the pin guide arms 122, pin guide support member 121 and puncture pin 119 towards the liquid repellent cartridge 117. This will result in rupturing of the cartridge and will free the liquid repellent so that it flows or oozes through the perforations in the perforated guide tube 113 as well as the perforations 127 in the outer linking unit housing member 130. If the pulling or tugging is continued, or if the pulling or tugging is violent in nature, the activation cords 124 will continue pulling the pin guide assembly 121 towards the collapsing cartridge 117 to thereby increase the rate of flow or oozing of the liquid repellent from the interior of the container housing member 130 through the liquid egress holes 127. As the propellent liquid egresses from the holes 127 it will be deposited upon the wearers' person or clothing and if he or she is in physical contact with an attacker, likewise will be deposited upon the attacker.

In the event of a surprise attack under conditions where the wearer is not first able to arm the device by releasing the safety lock lever arm 146 in the above described manner, the device nevertheless can be operated by the application of a suitable pulling or tugging force which results in a tension force on the safety cable equal to or exceeding approximately 25 lbs. With a pulling or tugging force of this magnitude, the heavy wire safety lever arm 146 is designed to bend sufficiently in the direction of the predesigned bend shown in FIG. 4, to become dislodged from under the depending detent portion 152 of safety catch switch assembly 141. This should result in freeing the eyelet 151 from the end of lever arm 146, but in any event is sufficient to produce enough slack to allow the activation cords 124 to be operated in the above described manner to release the liquid repellent in ampule 115.

A second species of the embodiment of the invention described in the preceeding paragraphs with relation to FIGS. 11–16, is illustrated in FIG. 17. The species of the invention shown in FIG. 17 likewise is designed to comprise either a belt or a necklace and employs one or more liquid repellent link units 130 identical to those described with relation to FIGS. 11–16. The species of the invention shown in FIG. 17 differs however in the construction of the safety catch unit 60 employed with the necklace or belt. In this species of the invention, the safety catch unit 60 may comprise a belt buckle or catch for the necklace.

The construction of the safety catch link unit 60 is best shown in FIGS. 17–20 and comprises a simultaneous release for the safety cables 129 employed to lock the repellent liquid dispensing unit 131 in the safety condition. FIG. 18 is a sectional plan view of the safety catch unit link 160 which comprises a relatively flat circular housing member having the eyelets 111 formed on opposite sides of its periphery for attachment to activation cords 124 of the liquid repellent dispensing unit links 130. Formed on the outer face of the round link housing member 160 is a rotor pin restraint ring 161 of generally annular configuration having two sets of lock pin recesses 162 and 163, respectively, formed in its inner periphery and located substantially 90° apart. As illustrated in FIG. 18, the rotor pin restraint ring 161 provides a first set of lock pin recesses 162 for maintaining the unit in the safe condition or configuration and the second set of lock pin recesses 163 to maintain the unit in the ready or armed condition. Safety cable egress openings 164 are provided through the rotor pin restraint ring 161 to allow egress of the safety cables 129 with one end of each safety cable 129 being secured to an eyelet 167 formed on a rotor member 166 that is supported for rotation within the restraint ring 161 by a rotor support axle 165. The rotor member 166 is slideably mounted in place on the rotor support axle 165 and is held there by a rotor cover plate spacer 172 mounted on the rotor support axle 165 beneath a rotor cover plate 173 best seen in FIG. 20 of the drawings. The cover plate 173 is held in place by an attachment screw 174 threaded into a mating threaded hole formed in the rotor support axle 165. FIG. 19 of the drawings shows a partial cross sectional view through one side of the rotor assembly with the cover plate 173 held in place in the above described manner.

The rotor member 166 is a generally elongated elliptically-shaped structure having a partition wall 171 secured in each of the opposite ends thereof to define a lock pin support chamber. A retractible rotor lock pin 168 is secured in each chamber and is biased outwardly by a suitable biasing spring disposed between the partition plates 171 and an upstanding, readily grasped hairpin turn formed in lock pin 168. The hairpin turn in lock pin 168 protrudes upwardly through aperture opening 176 in the rotor cover plate 173 as best shown in FIGS. 19 and 20. The rotor lock pin 168 has one end thereof extending through an opening in the partition plate 171 and secured there by a cotter pin, or other suitable means, and has the remaining free end thereof extending through a suitable hole formed in the end of the rotor member 166 and into respective ones of the lock pin recesses 162 or 163 formed in the rotor pin restraining ring 161. The rotor pin spring 170 acts in compression to keep the rotor lock pin 168 pressed into either the pair of lock pin recesses 162 for the safety lock position, or into lock pin recesses 163 for the ready-armed condition.

The device of FIGS. 17–20 is placed in the ready or armed condition by squeezing the two rotor lock pin-hairpin shaped protuberances 168 extending through cover plate 173 together towards the rotor support axle 165 to thereby free the rotor lock pins and enable the rotor member 166 to be rotated. With the rotor lock pins positioned in the lock pin recesses 162 as shown in FIG. 18 of the drawings, the safety cables 129 will be stressed, and the device will be set to the safety lock condition. However, upon rotation of the rotor member 166 in the above described manner to allow the lock pins 168 to be seated in the recesses 163, the safety cords 129 will be slacked so as to enable the wearer to operate the device through grasping or pulling on the actuation cables 124 in the manner previously described with respect to FIGS. 11–16. Thus, it will be appreciated that the device of FIGS. 17–20 operates in essentially the same manner as the device illustrated in FIGS. 11–16. There is one cnsiderable advantage to the device of FIGS. 17–20, however, and that is that it is more easily returned to the safety lock condition after it has been enabled or placed in the ready-armed condition for use by the wearer.

From the foregoing description it will be appreciated that the invention makes available a light-weight, portable, easily fabricated and relatively inexpensive repellent fluid dispensing device that is incorporated into a piece of jewelry or other suitable exterior wearing apparel or article so as to be inconspicuous. The device provides a means for forcibly ejecting or slowly flowing a liquid repellent that is applied to a potential attacker or intruder and that marks the intruder with both a foul and repulsive odor and a distinctive color marking which is visually apparent and readily viewed. Because of the nature of the fluid contained within the device, the device includes a means for positively preventing inadvertent release of the liquid or fluid from the device which means readily can be operated by a wearer to place the device in a ready-armed condition for use in situations of danger.

Having described several embodiments of a personal protective repellant dispensing device constructed in accordance with the invention, it is believed obvious that other modifications and variations of the invention are possible in the light of the above teachings. It is therefore to be understood that changes may be made in the particular embodiments of the invention described which are within the full intended scope of the invention as defined by the appended claims.

What is claimed is:

1. A personal protective repellent dispensing device comprising an exterior housing member of attractive appearance in the form of an article which normally is conveniently carried as an accessory by a person in a readily accessible manner and which disguises the nature of the device, container means for containing a fluid substance of foul and repulsive nature within the exterior housing member, said exterior housing member having at least one outlet opening to the exterior thereof communicating with said container means, selectively controllable dispensing means coacting with said container means for releasing a fluid substance contained therein through the outlet opening under the control of a person carrying the device, and positive acting safety lock means on said housing member for positively preventing inadvertent actuation of the selectively controllable dispensing means, said positive acting safety lock means including spring means under tension for positively locking the safety lock means in the safety lock position and requiring that the spring means be tensioned further in order to change the selectively controllable dispensing means from a safety locked position to a ready armed detent position where it can be selectively and readily operated by a person carrying the device in situations where it is desired to arm the device and condition it for operation by the selectively controllable dispensing means alone.

2. A personal protective repellent dispensing device according to claim 1 wherein the container means is filled with a fluid substance of foul and repulsive odor which also is colored so that upon release and contact with an intruder, the intruder will be marked both by a foul odor and a readily identified visually observable mark.

3. A personal protective repellent dispensing device according to claim 2 wherein the fluid substance is a synthetic liquid having the odor of a skunk and dyed with a brightly colored readily visually identified marking substance.

4. A personal protective repellent dispensing device according to claim 1 wherein the selectively controllable dispensing means can be returned to the safety locked position in the event the device is not operated while in the ready armed detent position.

5. A personal protective repellent dispensing device according to claim 4 wherein the selectively controllable dispensing means for ejecting the fluid under pressure comprises a spring actuated piston member movable within the container for pressurizing the fluid and ejecting it under pressure through the outlet opening upon operation of the selectively operable dispensing means.

6. A personal protective repellent dispensing device according to claim 4 wherein the fluid of foul and repulsive nature is retained in an ampule under pressure in mixture with an expansible gaseous substance in the container, and operation of the selectively controllable dispensing means releases the contents of the ampule through the outlet opening in the manner of an aerosol spray.

7. A personal protective repellent dispensing device according to claim 5 wherein the spring means under tension for positively locking the safety lock means in the safety locked position is comprised by the same spring as the spring for the spring actuated piston member.

8. A personal protective repellent dispensing device according to claim 7 wherein the spring actuated piston member has a guideway pin formed thereon riding in a guideway formed in the side of the container means, said guideway being in the form of an inverted horseshoe with one short leg and one long leg, the positive acting safety lock means being comprised by the short leg of the inverted horseshoe shaped guideway while the guideway pin is retained therein under tension by said spring means, and the ready armed detent position being formed by an indentation in the inverted horseshoe shaped guideway near the juncture of the short and long legs thereof with the guide pin disposed in said indentation under tension from said spring means.

9. A personal protective repellent dispensing device according to claim 8 further including means responsive to operation of the selectively controllable dispensing means for producing a loud noise simultaneously with the ejection of a fluid substance of foul and repulsive nature through the outlet opening.

10. A personal protective repellent dispensing device according to claim 8 wherein the fluid substance of foul and repulsive nature is retained in an ampule under pressure in a mixture with an expansible gaseous substance in the container and operation of the selectively controllable dispensing means releases the contents of the ampule through the outlet opening in the manner of an aerosol spray.

* * * * *